US008292651B1

(12) United States Patent
Lakeman et al.

(10) Patent No.: US 8,292,651 B1
(45) Date of Patent: Oct. 23, 2012

(54) HIGH VOLTAGE CONNECTOR WITH A RING ASSEMBLY TO FORCE A PLUG AXIALLY INTO A HEADER ASSEMBLY

(75) Inventors: Ryan C. Lakeman, Plymouth, MN (US); Randall J. Appleton, West St. Paul, MN (US); Dennis W. Borgwarth, Andover, MN (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 18 days.

(21) Appl. No.: 13/156,398

(22) Filed: Jun. 9, 2011

(51) Int. Cl.
*H01R 4/50* (2006.01)

(52) U.S. Cl. ..... 439/345

(58) Field of Classification Search ..... 439/345, 439/352, 281, 108, 272, 357
See application file for complete search history.

(56) References Cited

U.S. PATENT DOCUMENTS

| | | | | |
|---|---|---|---|---|
| 2,874,336 | A | 2/1959 | Wannemacker | |
| 3,551,881 | A | 12/1970 | Lockie et al. | |
| 4,179,582 | A | 12/1979 | Garcia | |
| 5,249,978 | A | 10/1993 | Gazda et al. | |
| 6,361,349 | B1 * | 3/2002 | Hung | 439/357 |
| 7,419,397 | B2 * | 9/2008 | Casperson et al. | 439/281 |
| 8,011,945 | B2 * | 9/2011 | Seong et al. | 439/345 |
| 2006/0030211 | A1 | 2/2006 | Graf et al. | |
| 2008/0318460 | A1 * | 12/2008 | Hsieh et al. | 439/345 |

* cited by examiner

*Primary Examiner* — Chandrika Prasad
(74) *Attorney, Agent, or Firm* — Patterson Thuente Christensen Pedersen, P.A.

(57) ABSTRACT

An output connector for a high voltage, high current power unit, including a plug assembly including a dielectric plug body having two conductive biplates arranged generally parallel to each other. The two conductive biplates abut a dielectric biplate backer and the two conductive biplates are separated by the dielectric biplate backer. A header assembly includes a dielectric header body presenting two substantially parallel, inwardly facing, vertical support walls on opposing sides of the receptacle recess. A bus bar assembly includes two contactors coupled to a flexible bus bar and abutting the vertical support walls. The two contactors are arranged such that a space exists between the contactors. A ring assembly is couplable to the plug assembly and structured to force the plug assembly axially inward to the header assembly whereby the biplates and the biplate backer are forced between the contactors.

16 Claims, 16 Drawing Sheets

HIGH VOLTAGE CONNECTOR WITH A RING ASSEMBLY TO FORCE A PLUG AXIALLY INTO A HEADER ASSEMBLY

This invention was made with Government support under U.S. Government Contract W911QX-08-C-0077, awarded by U.S. Army Contracting Command. The government has certain rights in the invention.

FIELD OF THE INVENTION

The invention generally relates to power lead end connectors for high voltage high current applications.

BACKGROUND OF THE INVENTION

Certain electrical applications involve the use of high voltage, high current devices. For example, certain applications store large charges in large, high capacity capacitors. An important consideration in high voltage high, current applications is the interface between the power source and the end item to which the power is delivered. The presence of high voltage high current electricity creates the possibility of arcing between the poles of the high voltage high current device. Large capacity capacitors in particular have a high potential for arcing.

In some applications, capacitors may create voltages in the realm of ten kilovolts when static charged and during discharge. In the past few years, there has been considerable improvement in the area of pulsed power research, which involves storing, shaping, performance of high energy density capacitors used in pulsed power applications. Pulsed power applications pertain to numerous areas including at least laser drivers, high power microwave generators, particle accelerators, nuclear fusion, electromagnetic mass drivers, medical equipment, and industrial manufacturing technology. High pulsed power systems with capacitors capable of energy in the 10 kV and 150,000 A range have also found military applications, including in current military vehicles and future combat systems. The requirements for components in pulsed power applications in military applications are more taxing that that of other market segments due to the systems being mobile rather than fixed emplacements, the systems operating in hostile environments rather than controlled climate laboratories, the systems requiring more periodic maintenance service, which needs to be quick and efficient without affecting safety, and the systems having other criteria requirements such as size and weight constraints, as well as performance criteria. A power connector capable of providing connection without arcing at such high power levels is not known by the inventors to exist in the prior art.

Another issue with the use of such high voltage and high current devices is isolation from the environment. In particular, the leakage of water into a power connection at these levels of voltage and current can create short circuiting and arcing in short order. While there may be connectors existing in the prior art to meet these sorts of dielectric and environmental constraints, so far as the inventors are aware they are capable of operating at a very small fraction of the power levels required for this specialized high voltage high current application.

SUMMARY OF THE INVENTION

The high voltage high current power lead end connector of the present invention addresses many of the above considerations. The connector of the invention provides a dielectric strength of over 10 kilovolts both for static charged high capacity capacitors and during discharge of high capacity capacitors. The connector of the present invention features a sufficiently high contact force between the power leads of the power connector and the high voltage, high current power source to minimize arcing of the contacts. Further, the connector of the present invention has a highly effective environmental seal between the exposed high voltage high current power leads and the outside environment. The environmental seal of the invention inhibits, for example, leakage of water into the connection between the high voltage high current power unit and the connector. The connector of the invention is capable of withstanding an operating voltage of over 10 kilovolts between the hot and ground sides of an internal storage device such as a high voltage high current capacitor. The selection of materials and design of the connector takes into account surface creep of voltage.

The connector of the present invention has geometry and materials appropriate to provide an effective spring behind conducting copper leads of the connector which then forces the contacts together. An external ring is applied to the connector and screwed down with a wrench to provide the axial force to cause the proper contact force.

The external ring forces the connector into the receptacle which loads the spring which in turns provides the necessary contact force to prevent arcing under high voltage, high current loads. The connector achieves a high quality environmental seal by use of elastomeric material sandwiched between the outside environment and the internal power supply components by application of the external ring. The ring according to the present invention is further structured to be easily torque to tightness by application of a standard square drive socket tool. The ring also includes drain holes to drain any water that may come in contact with the outside of the connector. The inside of the external ring includes a sealing ring formed from a low friction material structured to spin freely with the external ring during installation to reduce operator effort in tightening the seal and create a more repeatable seal. The low friction sealing ring spins freely during installation but is contained by the external ring to inhibit loss of the low friction sealing ring.

A power unit according to an example embodiment of the present invention generally includes a housing, capacitors and an output connection. The housing includes a box having a cover, a battery coupler and a control coupler. The cover defines connector openings through which an output connector according to an example embodiment of the present invention passes. The capacitors are high voltage high current capacitors having a high level of capacitance.

The output connector according to an example embodiment of the present invention generally includes a plug assembly, a header assembly, a dust cap and a ring assembly.

The plug assembly generally includes a plug body supporting conductive biplates. The biplates are supported in a generally parallel fashion through and within the plug body.

The plug body is a generally unitary structure including an inner extension, an outer extension and a centrally located disk.

The plug body defines internal biplate passages.

The inner extension generally includes a ridge, a biplate backer, two end plates, a symmetrical polarity slot and a rail receiving slot at a distal end thereof. The two end plates are oriented generally perpendicular to the ridge. The inner extension ridge extends generally perpendicular to the disk and to the biplate backer.

The outer extension generally defines recess finger pulls thereon and biplate ridges extending outwardly away from the finger pulls. The biplate passages pass through and are defined by the biplate ridges of the outer extension as well as the ridge of the inner extension.

The disk of the plug body is generally circular in structure and defines an annular ridge and a plateau extending outwardly perpendicularly from the disk in the same direction as the outer extension. The disk may also present polarity markings thereon to identify negative and positive polarities of the plug body.

The biplates are formed of a highly conductive metallic material such as for example, copper. According to an example embodiment of the present invention, the biplates include a straight portion, a tapered portion, a hook portion and an external portion. The biplates pass through the plug body and are positioned within the biplate passages. The external portion of the biplates extends outwardly beyond the biplate ridges of the outer extension. The straight portion of the biplates extends along the biplate backer while the tapered portion and hook portion extend around the distal edge of the biplate backer.

The header assembly is structured to receive the plug assembly and generally includes the header body and bus bar assembly.

The header body is structured to be securable by fasteners to the capacitor. The header body is a generally unitary non-conductive dielectric structure formed of a non-conductive material such as high density polyethylene (HDPE) or polytetrafluoroethylene (PTFE). The header body defines a receptacle recess therein. The receptacle recess further presents two contactor recesses, a rail and an inner extension recess. The contactor recess is bordered by a vertical bus bar wall. The header body also defines a bus bar passage.

The bus bar assembly generally includes a flexible bus bar, a backer bar, fasteners, contactors and contactor fasteners. The flexible bus bar is a generally L-shaped structure formed from a conductive material such as copper. The lower limb of the L shaped structure includes apertures by which the flexible bus bar may be coupled to the capacitor by fasteners passing through the apertures. The longer limb of the L-straight shaped structure extends upwardly and is adapted to be coupled to the contactors. The upper limb may include apertures through which contactor fasteners may be used to couple the contactor to the flexible bus bar. The bus bar assembly passes through the bus bar passage in the header body.

The dust cap according to an example embodiment of the present invention generally includes a larger ring, a small ring and an intervening annular plateau. The small ring of the dust cap is dimensioned to slip fit within the connector openings of the power unit cover. The large ring internal diameter is dimensioned to slip fit with the header body.

The ring assembly generally includes a thread on ring and a ring receiver.

The thread on ring generally includes a body presenting a threaded portion, a tool interface, a disk receiver, a disk retainer and several flats. The thread on ring also includes a low friction annular sealing ring which is dimensioned to fit within the disk receiver of the thread on ring body.

The ring receiver generally includes an external threaded portion and a cover interface. The cover interface may be coupled to the housing cover.

According to an example embodiment of the present invention, the plug assembly is receivable within the header assembly and passes through the connector openings in the cover of the housing box. The inner extension of the plug assembly is dimensioned to be received within the header assembly between the contactors. The header body is structured so that the contactors are prevented from moving outwardly excessively by the vertical bus bar wall. The plug assembly is then secured in the header assembly by axial force created by tighten the ring assembly onto the ring receiver. When the plug assembly is placed into the header assembly in this fashion, the biplates are forced in between the contactors such that an appropriate contact force is applied to prevent arcing during discharge of the capacitor. The contactors contact the biplates in the straight portion of the biplates.

The ring assembly is applied so that the thread on ring is screwed onto the threaded ring receiver and the thread on ring engages the disk of the plug assembly thereby forcing the plug assembly toward the header assembly. The thread on ring may be tightened by application of an appropriate wrench to the flats or by application of a tool to the tool interface. In an example embodiment of the present invention, the tool interface includes a recess appropriately shaped to receive a conventional square drive ratchet handle or similar tool.

An example embodiment of the present invention, the disk receiver of the thread on ring receives a low friction sealing ring therein. The low friction sealing ring bears against the elastomeric annular ridge of the disk to axially press the plug body against the header assembly.

The dust cap may be positioned so that the large ring is positioned over the header assembly and the small ring thereof passes through the connector openings of the cover of the housing box. The dust cap provides a closely fitting engagement of the small ring outside diameter to slip fit with the connector openings and the large ring inside diameter in a closely fitting slip fit with the header assembly.

DETAILED DESCRIPTION OF THE DRAWINGS

Figure 1:
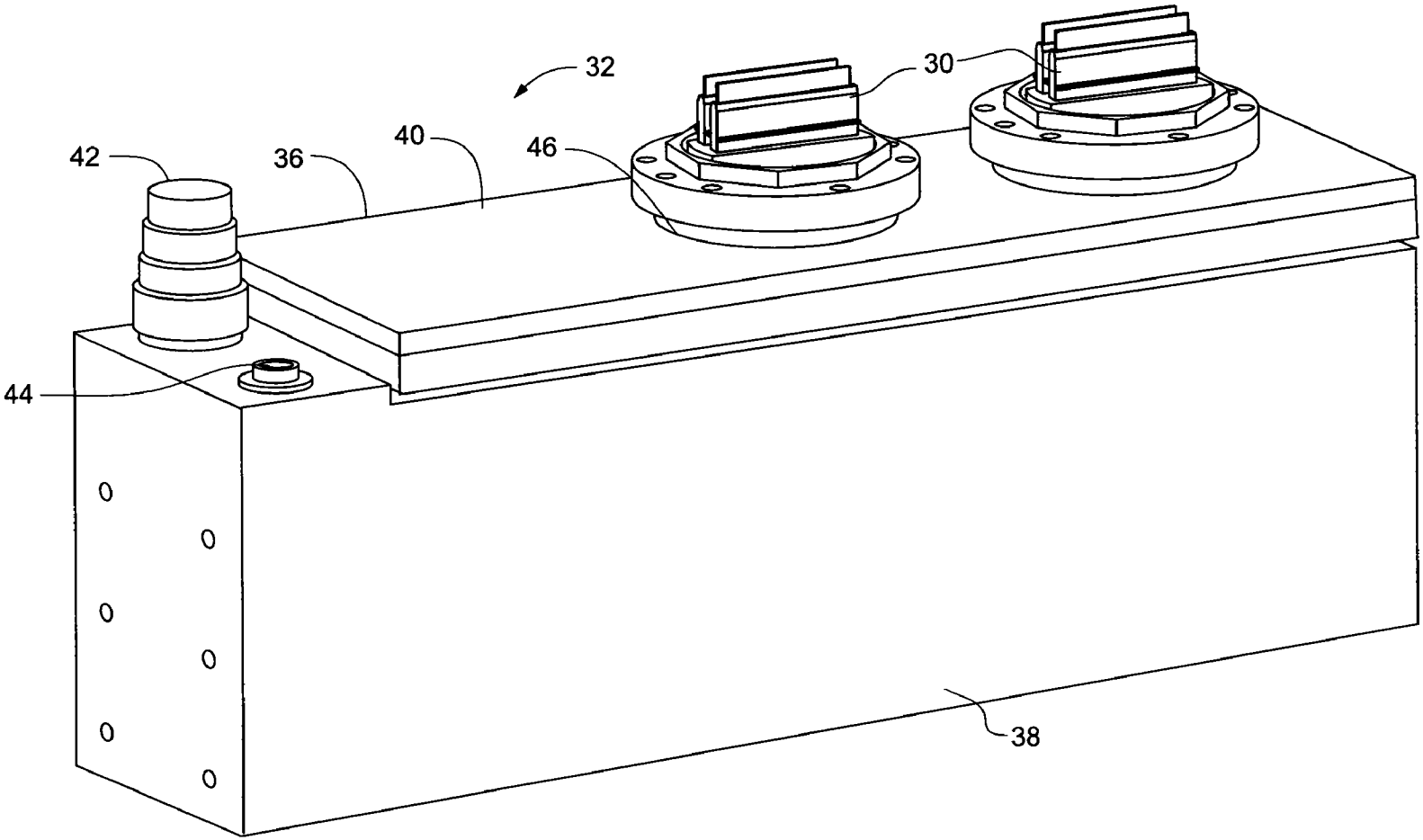
FIG. 1 is a perspective view of a high voltage high current power unit including two output connectors according to an example embodiment of the present invention.
Figure 2:
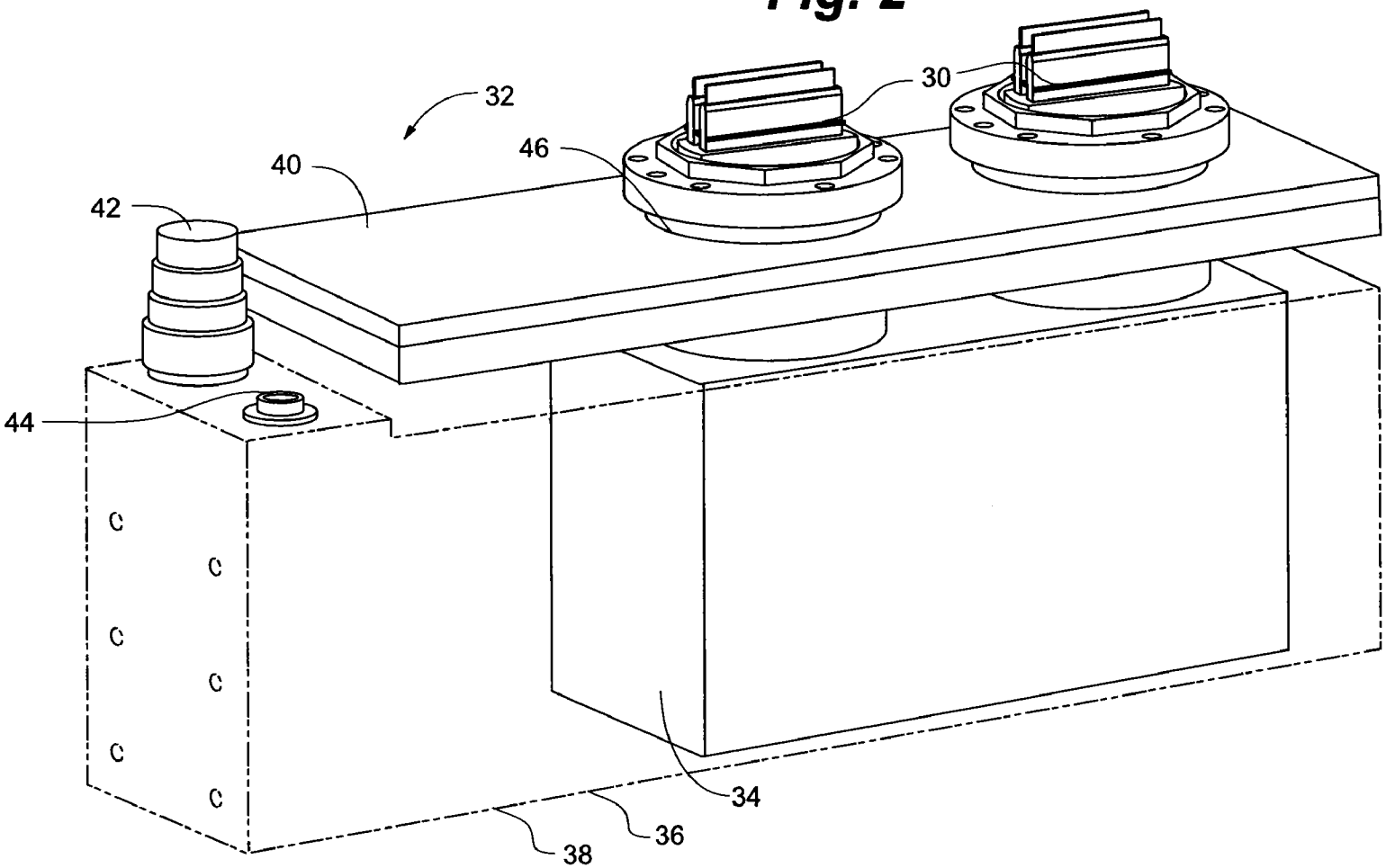
FIG. 2 is a perspective partially phantom view of the power supply of FIG. 1 showing a capacitor therein.

Referring to FIGS. 1 and 2, output connector 30 according to an example embodiment of the present invention is utilized with power unit 32 including capacitors 34. Power unit 32 is a high voltage high current power unit and as such requires an output connector sufficient to handle at least ten kilovolts of electrical output at 150,000 amps during discharge of capacitors 34. Discharge may occur in times periods in the submillisecond range.

Figure 3:
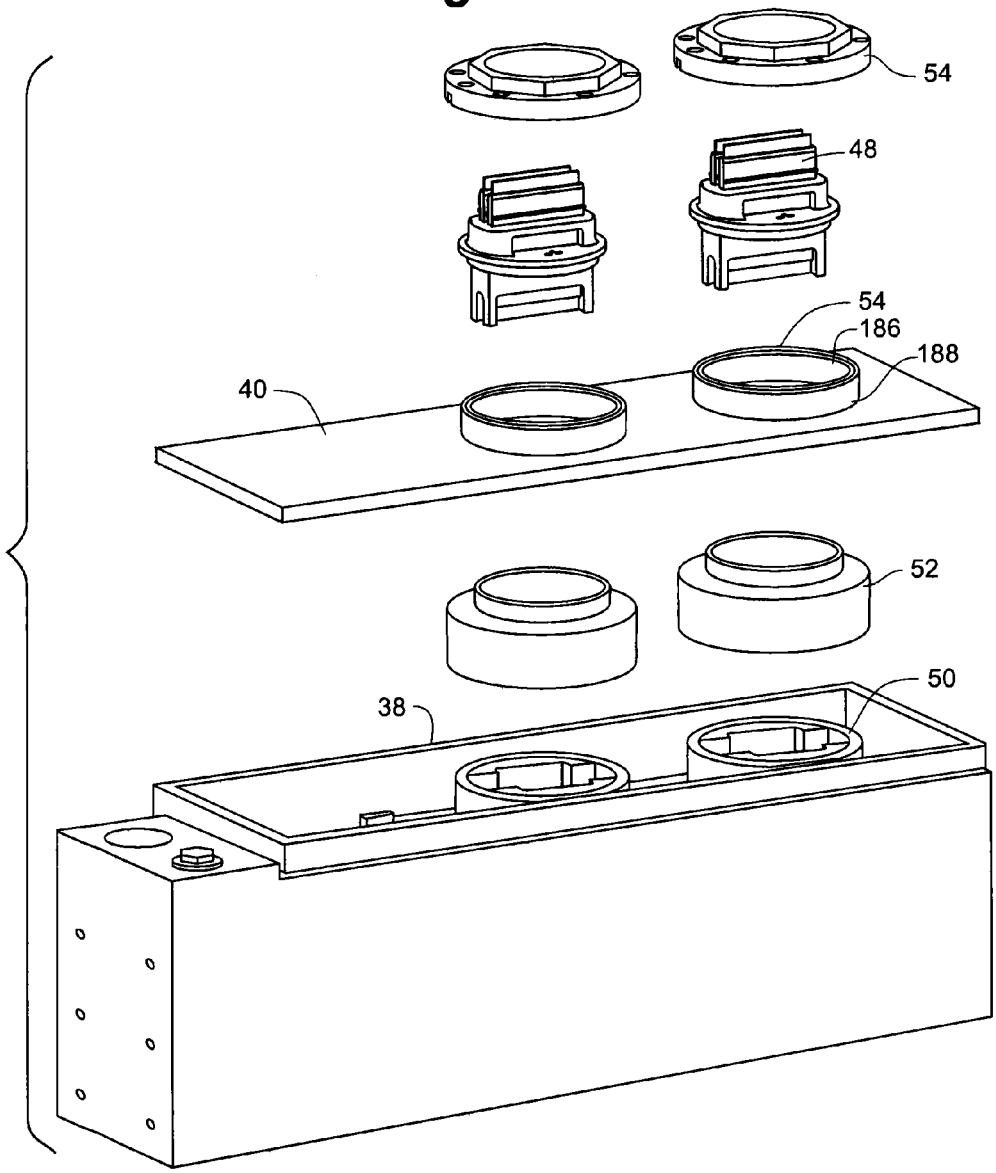
FIG. 3 is a partially exploded perspective view of the power supply depicted in FIG. 1.
Figure 4:
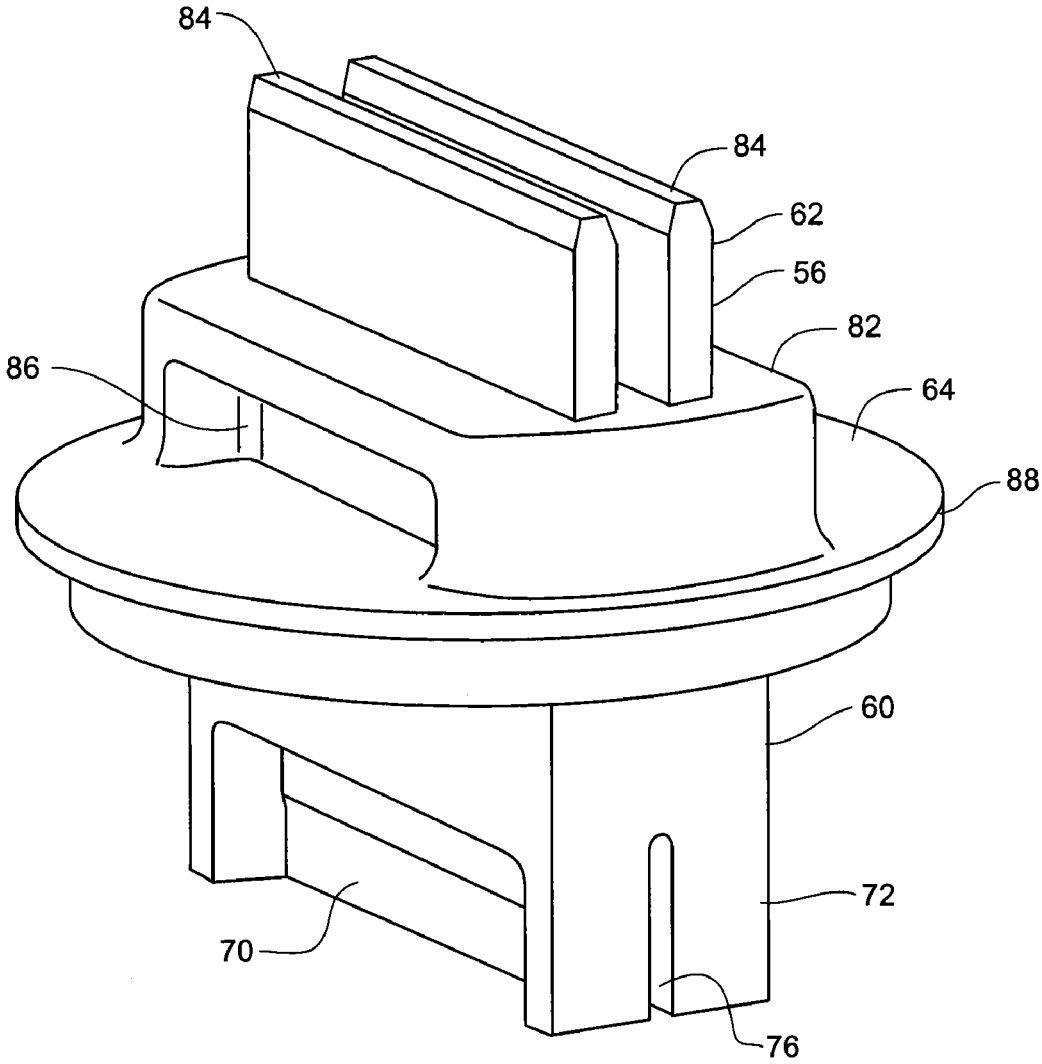
FIG. 4 is a perspective view of a plug assembly according to an embodiment of the present invention.
Figure 5:
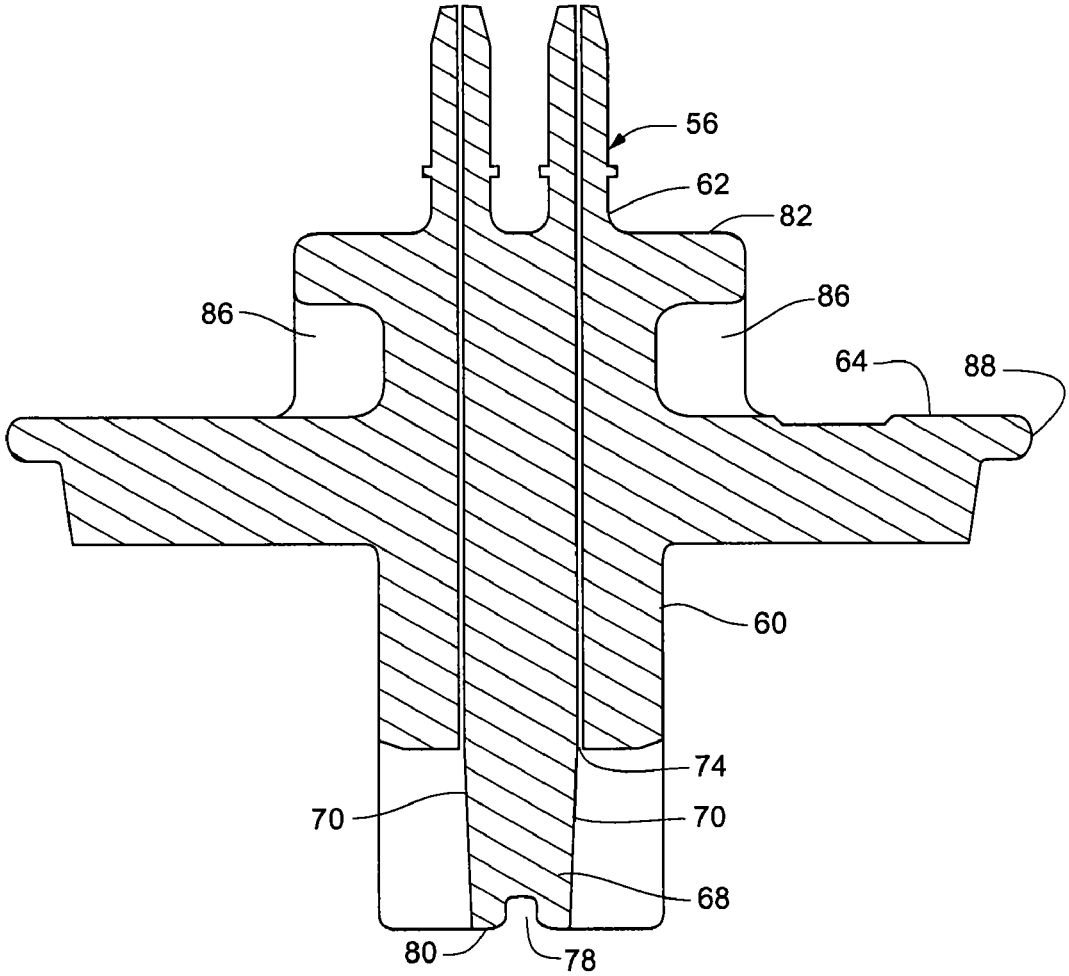
FIG. 5 is a cross sectional view of a plug assembly as depicted in FIG. 4.
Figure 6:
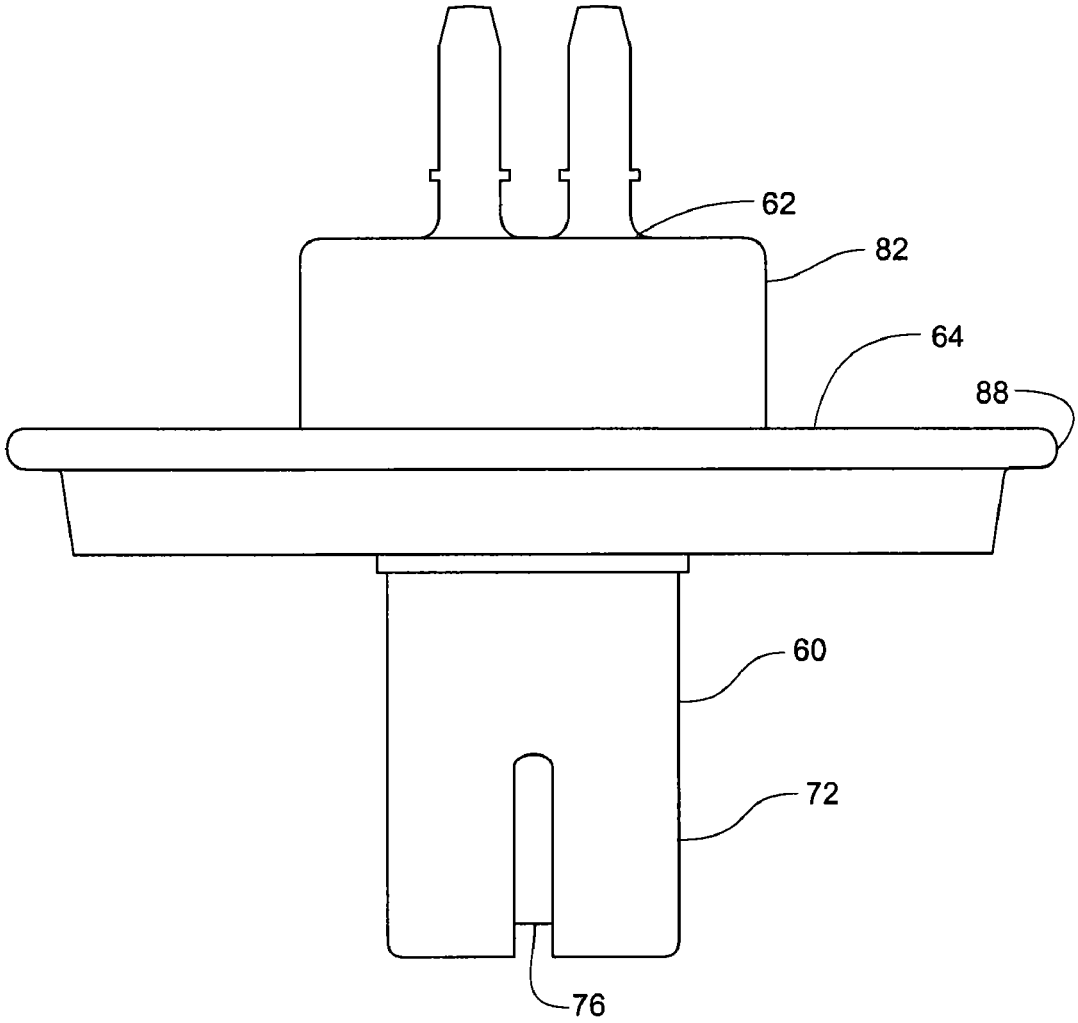
FIG. 6 is a plan view of a plug assembly as depicted in FIG. 4.
Figure 9:
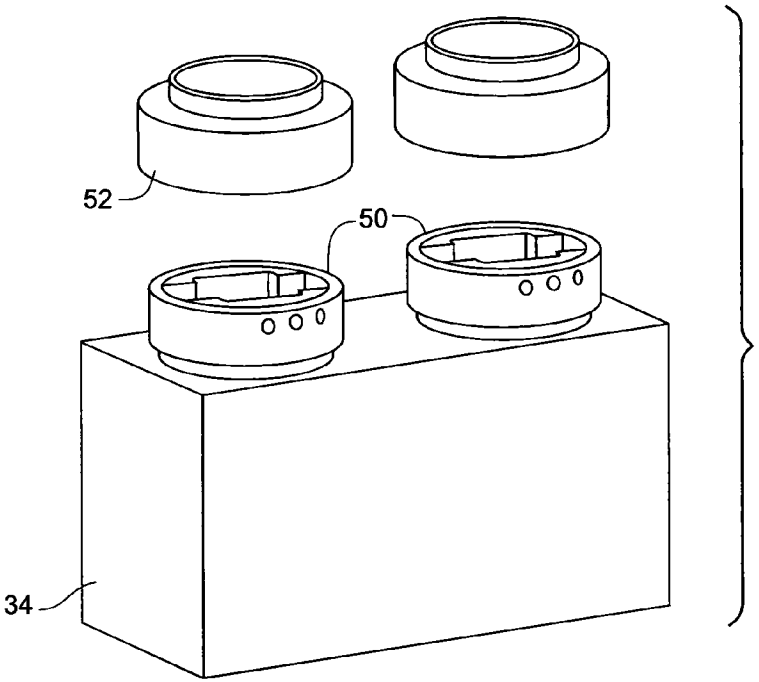
FIG. 9 is a partially exploded perspective view of dust covers and a header body on a capacitor according to an embodiment of the present invention.
Figure 7:
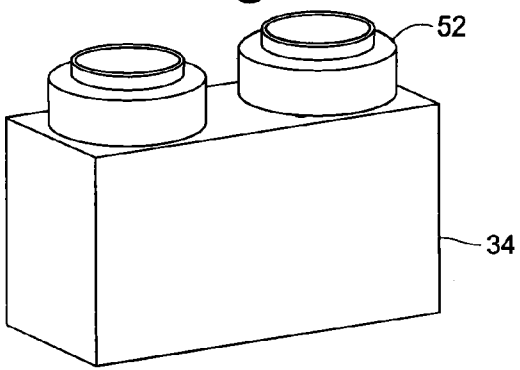
FIG. 7 is a perspective view of a capacitor including dust covers according to an embodiment of the present invention.
Figure 8:
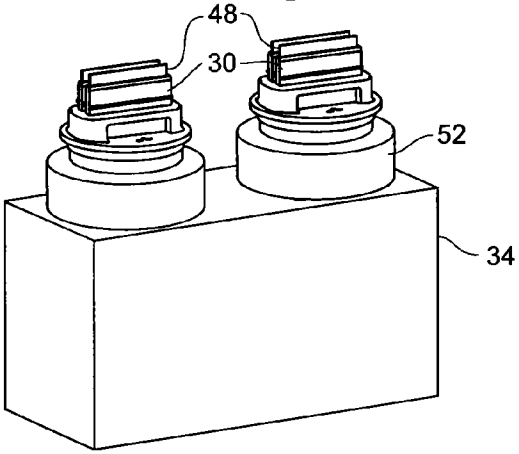
FIG. 8 is a perspective view of a capacitor including dust covers and showing a plug assembly in accordance with the present invention.
Figure 10:
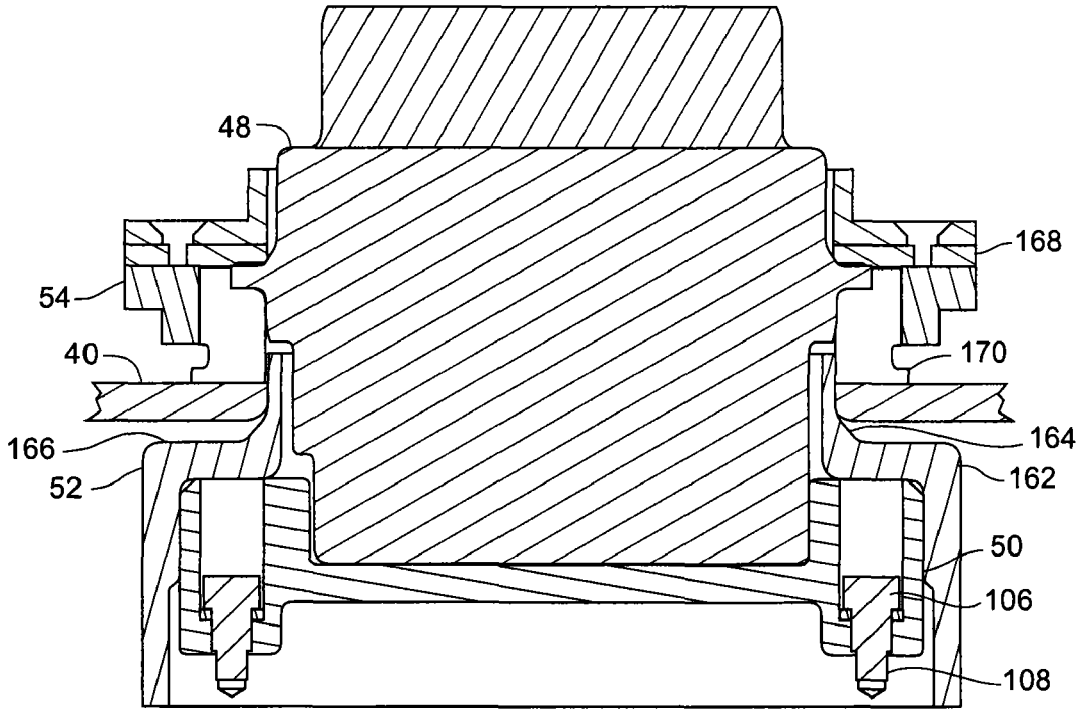
FIG. 10 is a cross sectional view of a capacitor, header, plug assembly and dust cover according to an embodiment of the present invention.

Referring to FIGS. 1-3, power unit 32 generally includes, in an example embodiment, housing 36, along with capacitors 34. Housing 36 generally includes box 38 and cover 40. Cover 40 is structured to couple with box 38 to enclose capacitors 34 in a weather resistant fashion. Box 38, in this example embodiment, presents battery coupler 42 and control coupler 44. Battery coupler 42 is adapted to couple power unit 32 to a battery power supply (not shown) while control coupler 44 is adapted to couple power unit 32 to a controller (also not shown). Cover 40 may present connector openings 46 passing therethrough.

Referring generally to FIGS. 4-6 and 9-13, output connector 30, according to an example embodiment of the invention, generally includes plug assembly 48, header assembly 50, dust cap 52 and ring assembly 54. Plug assembly 48 is structured to couple with header assembly 50. Dust cap 52 is generally structured to inhibit dust and contaminants from entering output connector 30. Ring assembly 54 is generally structured to secure plug assembly 48 to header assembly 50.

Referring to FIGS. 4-6 and 12 and 13, plug assembly 48 generally includes plug body 56 and biplates 58. Plug body 56 generally partially surrounds and supports biplates 58.

Plug body 56 is generally a unitary structure formed of a dielectric material. Plug body 56 generally includes inner extension 60, outer extension 62 and disk 64. Plug body 56 may be formed from a polymer material. For example, plug body 56 may be formed from a PTFE polymer overmolded with a polyurethane polymer.

Referring to FIGS. 4-6 and 12 and 13, in the depicted embodiment, inner extension 60 generally presents ridge 68, biplate backer 70 and endplates 72. Inner extension 60 also defines biplate passages 74. Inner extension 60 presents asymmetrical polarity slot 76 and rail receiving slot 78. Ridge 68 is generally perpendicular to endplate 72. Endplates 72 generally bound ridge 68 at its peripheral edges. Biplate backer 70 extends generally outwardly away from disk 64 on either side of ridge 68. Biplate passage 74 extends coaxially with surfaces of biplate backer 70 and into inner extension 60. Asymmetrical polarity slot 76 is presented on one of endplates 72. Rail receiving slot 78 runs along end 80 of ridge 68 generally parallel thereto.

Outer extension 62 generally includes plateau 82 with biplate ridges 84 on top thereof. Plateau 82 also presents finger pulls 86 on sides thereof. Plateau 82 extends outwardly away from disk 64 and biplate ridges 84 extend outwardly away from plateau 82. Finger pulls 86 are indentations into the sides of plateau 82.

Disk 64 is located intermittent between inner extension 60 and outer extension 62 and is generally circular in shape. Disk 64 presents annular ridge 88 on an outer perimeter thereof. Annular ridge 88 may be overmolded with an elastomeric polymer.

Figure 12:
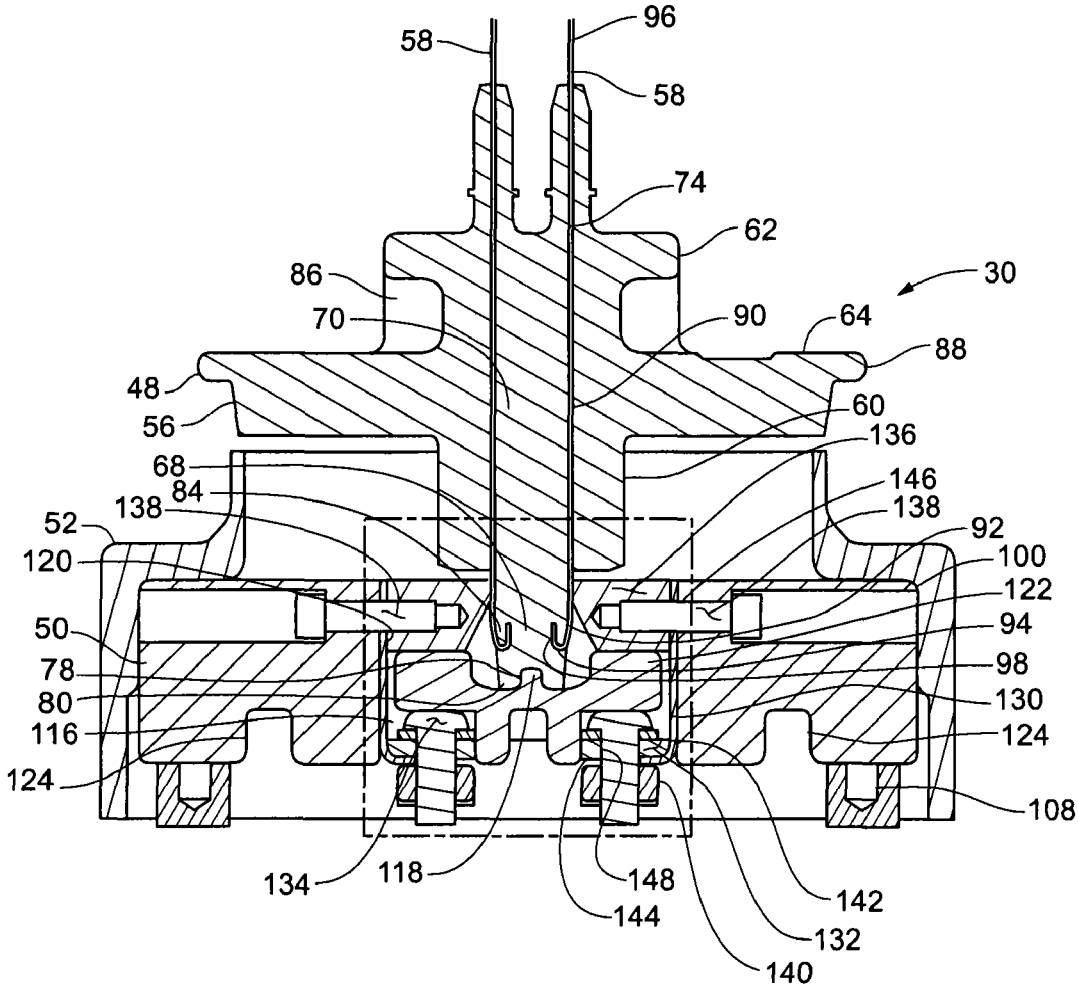
FIG. 12 is a cross sectional view of a plug assembly and a header assembly located on a capacitor according to an example embodiment of the present invention.

Biplates 58 are formed of a highly conductive metallic material such as copper. Biplates 58, as best seen in FIG. 12, generally present straight portion 90, tapered portion 92, hook portion 94 and external portion 96. Biplates 58 are positioned abutted to biplate backer 70 on opposite sides thereof. Biplates 58 pass through biplate passages 74 and extends outwardly slightly beyond biplate ridges 84. In an example embodiment, hook portion 94 of biplates 58 is received into hook receptacle 98 in biplate backers 70.

Referring to FIGS. 10-14, header assembly 50 generally includes header body 100 and bus bar assembly 102. Header body 100 is a substantially unitary structure formed of a dielectric material such as PTFE or HDPE. Bus bar assembly 102 includes a variety of components and is generally formed of highly conductive materials such as, for example, copper.

Figure 11:
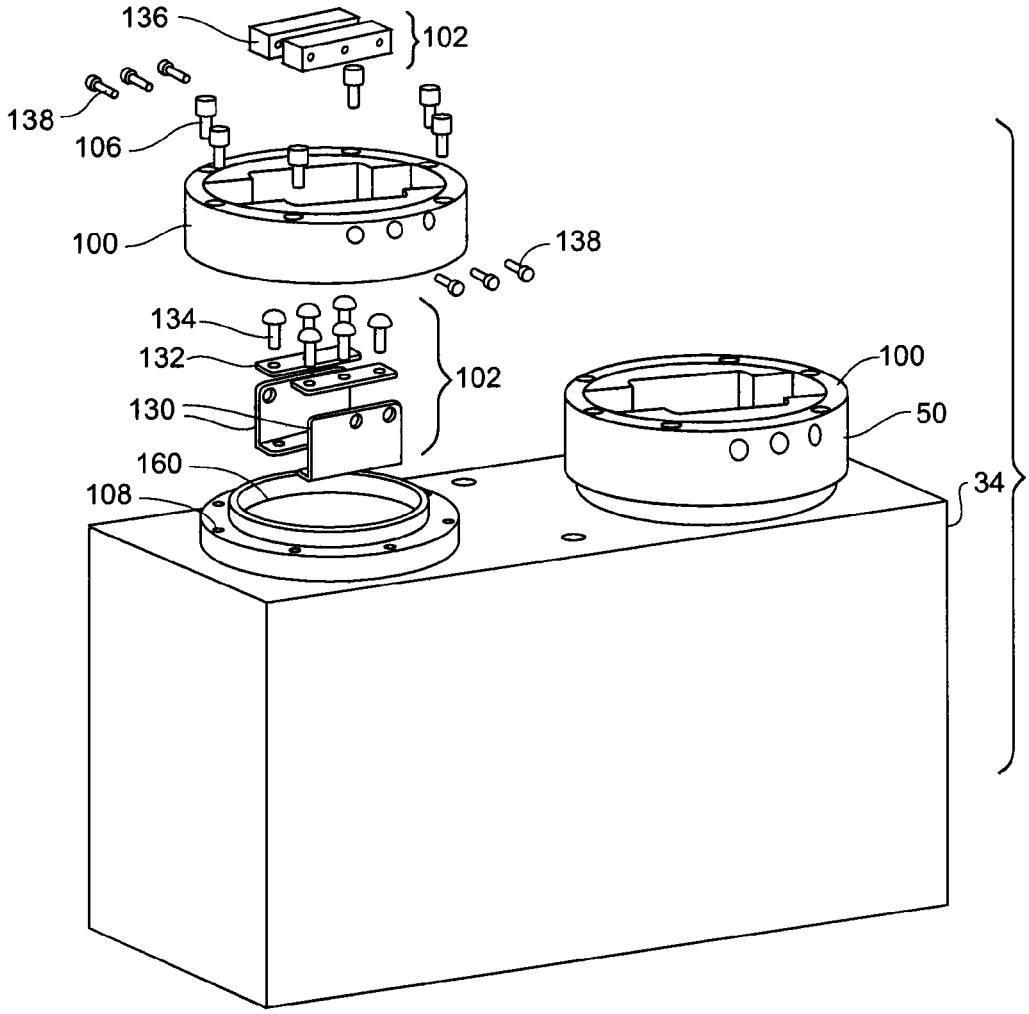
FIG. 11 is a perspective view of a capacitor and a header assembly showing one header assembly in an exploded view.

Header body 100 generally has the form of a short circular cylinder in the depicted example embodiment. Referring particularly to FIG. 11, header body 100 may include a number of apertures 104 therethrough adapted to receive fasteners 106 for coupling to capacitors 34. Capacitors 34 may include threaded holes 108 to receive fasteners 106.

Figure 13:
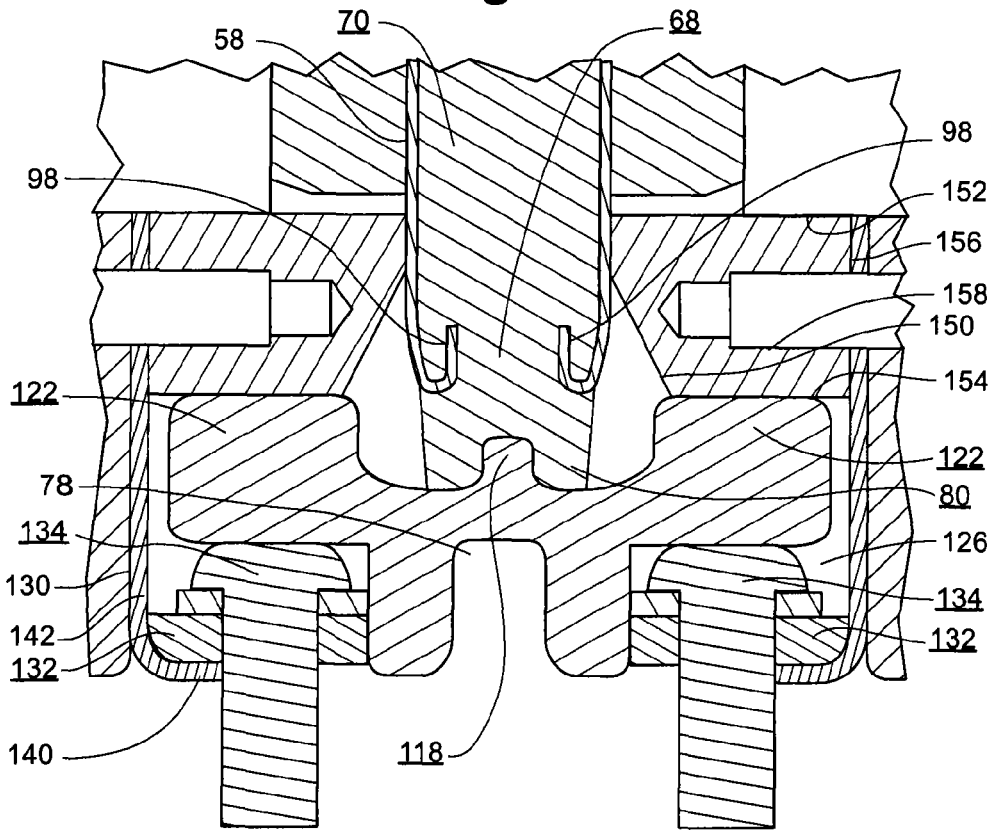
FIG. 13 is a detailed view taken from FIG. 12.
Figure 14:
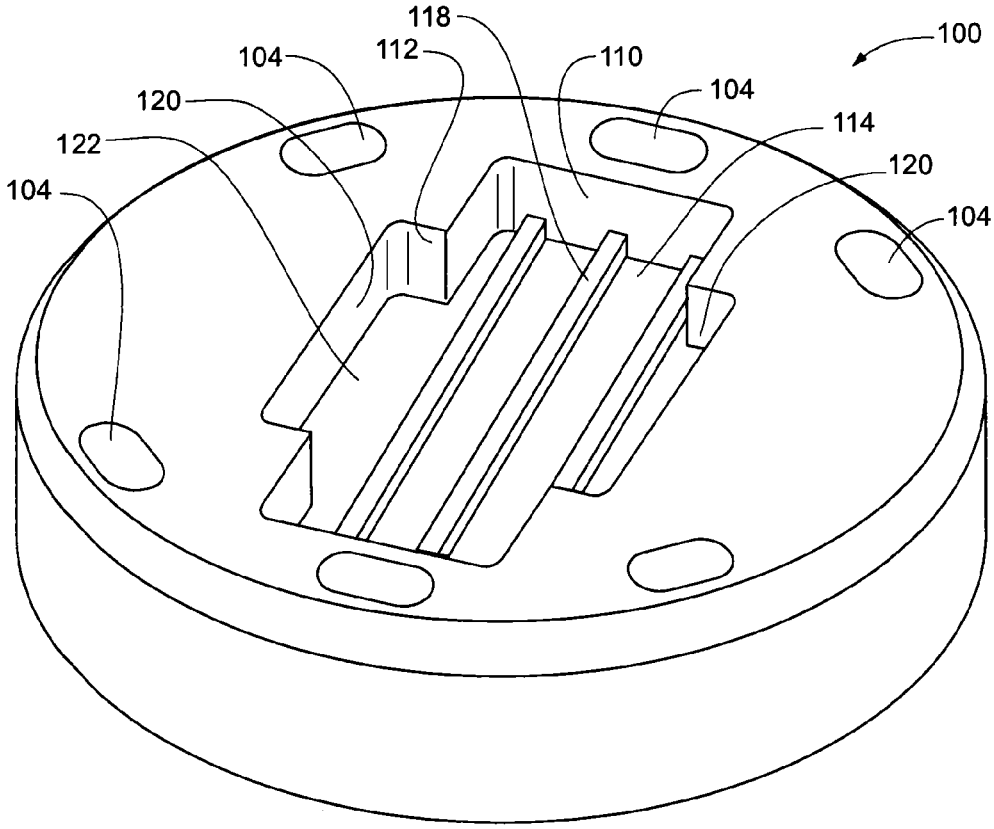
FIG. 14 is a perspective view of a header body according to example embodiment of the present invention.

Referring particularly to FIGS. 12-14, header body 100 defines receptacle recess 110. Receptacle recess 110 can generally be divided into contact recess 112, inner extension recess 114 and bus bar passage 116 passing through header body 100.

Inner extension recess 114 presents rail 118 therein. Contactor recess 112 is defined by and presents vertical bus bar wall 120 and support shelf 122.

On a bottom side thereof, header body 100 presents alignment recesses 124 and backer bar recesses 126. Capacitors 34 may present alignment structures (not shown) complementary to alignment recesses 124.

Referring to FIGS. 11-13, bus bar assembly 102 generally includes flexible bus bar 130, backer bar 132, fasteners 134, contactors 136 and contactor fasteners 138. In one aspect, flexible bus bar 130 is a generally L-shaped structured including short limb 140 and long limb 142. Flexible bus bar 130 is formed of a highly conductive metallic material. According to an example embodiment of the present invention, short limb 140 present capacitor apertures 144 and long limb 142 presents contactor apertures 146. Backer bar 132 is a generally rectangular structure presenting backer bar apertures 148. Backer bar apertures 148 are aligned with capacitor apertures 144, both of which are sized to receive fasteners 134 therethrough.

Contactors 136 are a relatively heavy structures made of highly conductive material such as copper. Contactors 136, in the depicted embodiment, present tapered side 150, top 152, bottom 154 and back 156. Back 156 presents threaded bores 158 therein.

Referring particularly to FIGS. 11-13, short limb 140 of flexible bus bar 130 abuts terminal 160 of capacitor 34 when installed. Fasteners 134 pass through backer bar 132 and through capacitor apertures 144 to secure flexible bus bar 130 to terminal 160 of capacitor 34. Long limb 142 of flexible bus bar 130 passes through bus bar passage 116. Long limb 142 of flexible bus bar 130 also abuts vertical bus bar wall 120.

Contactor fasteners 138 pass through header body 100, contactor apertures 146 and are secured in threaded bores 158 of contactors 136.

Referring to particularly to FIGS. 7-10, dust cap 52 is a substantially unitary structure and generally includes large ring 162, small ring 164 and annular plateau 166. Large ring 162 is joined to small ring 164 by annular plateau 166. Dust cap 52 may be formed by molding or other known techniques for example of a polymer material. An outer diameter of small ring 164 is dimensioned to slip fit within connector openings 46. An inner diameter of large ring 162 is dimensioned to slip fit around header body 100.

Ring assembly 54 as best seen in FIGS. 3 and 16-18 generally includes thread on ring 168, ring receiver 170 and sealing ring 172.

Figure 16:
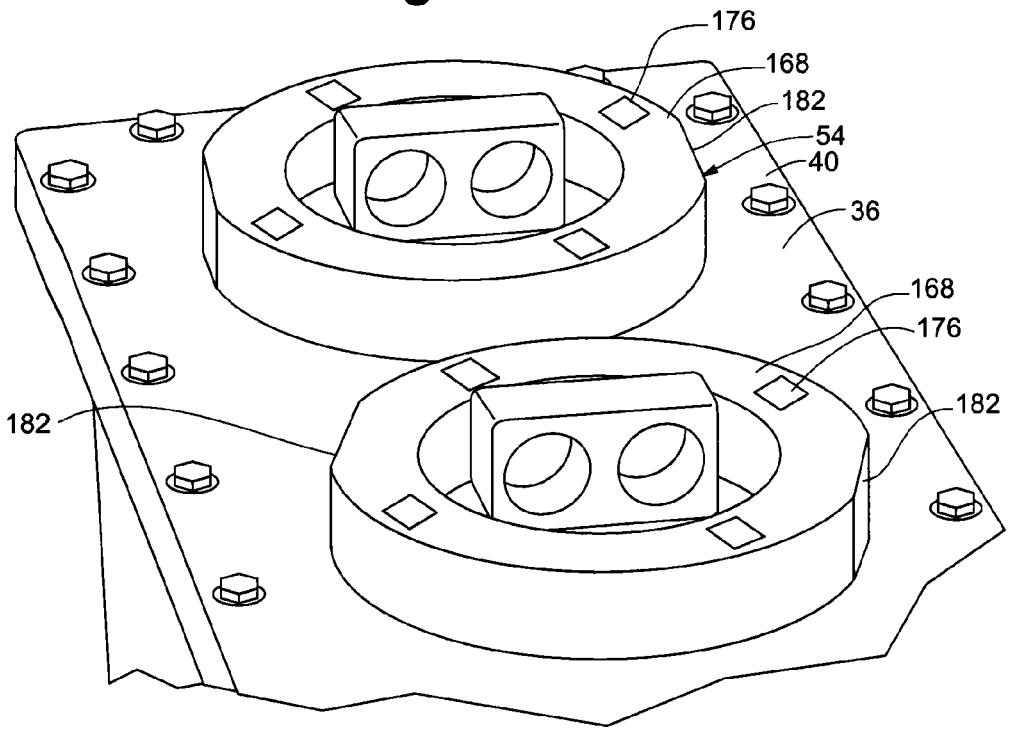
FIG. 16 is a perspective view of two ring assemblies according to an example embodiment of the present invention.
Figure 17:
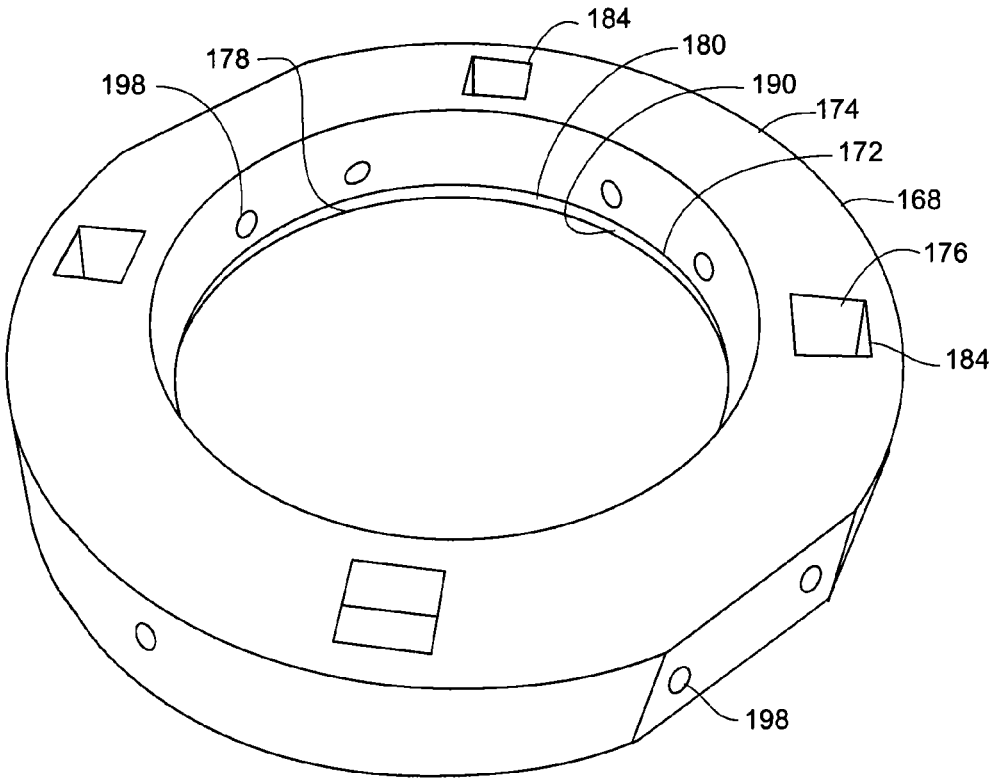
FIG. 17 is a top perspective view of a ring assembly according to an example embodiment of the present invention.
Figure 18:
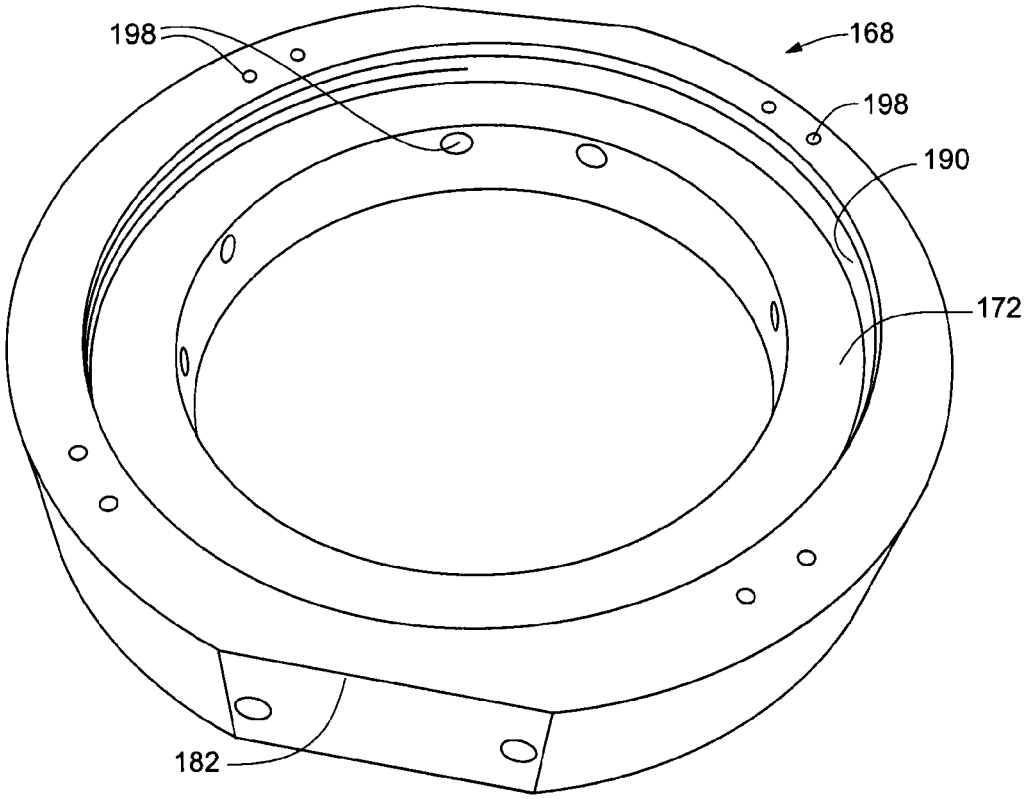
FIG. 18 is a bottom perspective view of the ring assembly according to an example embodiment of the present invention.

Referring particularly to FIGS. 16-18, thread on ring 168 generally includes ring body 174 defining tool interface 176, sealing ring receiver 178, sealing ring retainer 180 and flats 182. Ring body 174 may be formed of a metallic or polymeric material. Tool interface 176 may include, for example, square holes 184 appropriately sized to receive a standard square drive tool such as a square drive ratchet handle. Sealing ring receiver 178 is properly dimensioned to receive sealing ring 172 therein. Sealing ring retainer 180 is structured to prevent sealing ring 172 from falling out of ring body 174. Flats 182 are dimensioned to receive a large wrench (not shown).

Sealing ring 172 is preferably formed of a low friction material such as PTFE.

Ring receiver 170 generally includes threaded portion 186 and cover interface 188. Threaded portion 186 is structured to complement and mate with threaded portion 190 of ring body 174. Cover interface 188 is adapted to secure ring receiver 170 to cover 40.

Sealing ring receiver 178 receives sealing ring 172 therein. When thread on ring 168 is threaded onto ring receiver 170, sealing ring 172 is captured therebetween and compressed between thread on ring 168 and ring receiver 170 creating a weather tight seal.

Figure 15:
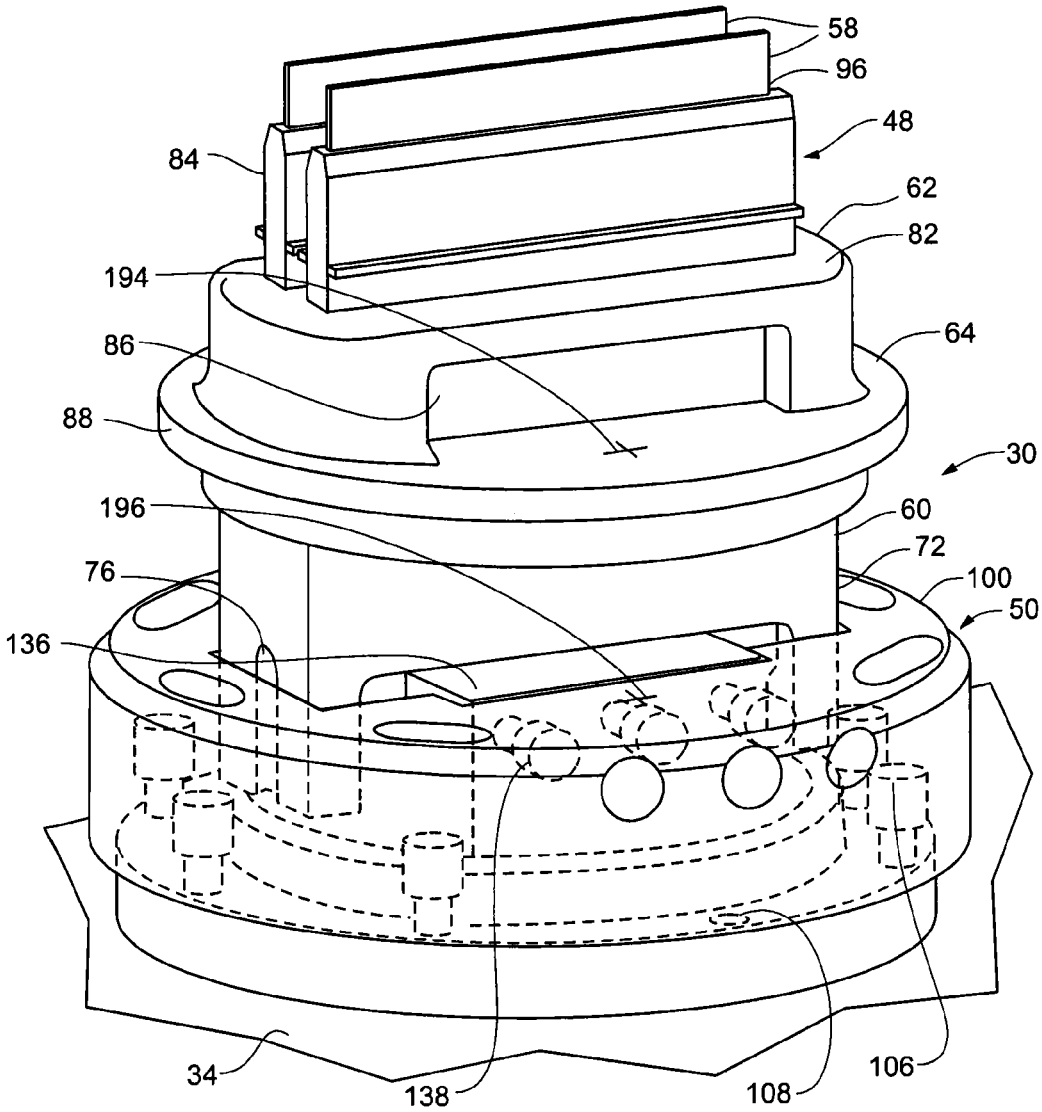
FIG. 15 is a perspective view of an output connector assembly with certain structures shown in phantom view.

Referring particularly to FIG. 15, header body 100 presents asymmetrical polarity ridge 192. Asymmetrical polarity ridge 192 is structured to mate to asymmetrical polarity slot 76. Plug body 56 may present polarity markings 194 thereon. Header body 100 may also present polarity markings 196.

In operation, output connector 30 couples power unit 32 to another electrical component. Plug assembly 48 is electrically coupled to paired conductors (not shown). Header assembly 50 is coupled to capacitors 34. Referring particularly to FIGS. 11-13, to couple header assembly 50 to capacitors 34, flexible bus bar 130 is brought into abutment with terminals 160 of capacitors 34. Backer bar 132 is brought into contact with short limb 140 of flexible bus bar 130 so that short limb 140 is sandwiched between terminal 160 and backer bar 132. Fasteners 134 are then inserted through backer bar 132 and short limb 140 of flexible bus bar 130 into terminal 160 of capacitors 34 and tightened appropriately. Header body 100 is then placed over flexible bus bar 130 so that flexible bus bar 130 passes through bus bar passages 116. Header body 100 is then secured to capacitors 34 by insertion of fasteners 106. Fasteners 106 may then be tightened. Contactors 136 are then inserted into contactor recess 112. Contactors 136 are positioned so that tapered side 150 of contactors 136 faces inwardly. Contactor fasteners 138 are then passed through header body 100 and contactor apertures 146 in long limb 142 of flexible bus bars 130. Contactors fasteners 138 are then threaded into threaded bores 158 of contactors 136 and tightened.

Dust cap 52 is placed over header body 100 so that the header body 100 is received within large ring 162 of dust cap 52 in a slip fit. Capacitors 34 are positioned within box 38 of housing 36 and cover 40 is applied so that small ring 164 of dust cap 52 is within connector openings 46 of cover 40. Cover 40 is then secured to box 38.

When it is desirable to electrically couple plug assembly 48 to header assembly 50, plug assembly 48 is inserted into header assembly 50 so that asymmetrical polarity slot 76 is aligned with asymmetrical polarity ridge 192. Polarity markings 194 and polarity markings 196 assist with this alignment. Upon insertion of tapered portion 92 of biplates 58 and into the space between contactors 136 contactors 136 are forced apart against vertical bus bar wall 120 by the presence of biplates 58 and biplate backer 70. Upon further insertion, straight portion 90 of biplates 58 is pressed between contactors 136. Contactors 136 meet biplates 58 with a force sufficient to prevent arcing between contactors 136 and biplates 58. When fully inserted rail receiving slot 78 engages rail 118 which serves to increase the tracking distance between biplates 58 and provides a centering feature.

External portion 96 of biplates 58 may be coupled to conductors (not shown) for example, by riveting.

Once plug assembly 48 is fully inserted into header assembly 50, ring assembly 54 may be assembled. Thread on ring 168 is placed on ring receiver 170 and tightened by hand or by engagement of a tool to tool interface 176 or engagement of a wrench to flats 182. Tightening of thread on ring 168 to ring receiver 170 compresses sealing ring 172 and elastomeric annular ridge of plug body 56 providing a weather tight seal.

The application of backer bar 132 provides uniform loading of flexible bus bar 130 onto terminals 160 of capacitors 34. Flexible bus bar 130 is supported during discharge of capacitors 34 by vertical bus bar wall 120 assuring that tight contact is maintained between contactors 136 and biplates 58. This is particularly important because of possible heating of flexible bus bar 130 during discharge because of the high power levels involved. Contactor 136 is also supported by support shelf 122 of header body 100 so that stresses created during insertion of plug assembly 48 into header assembly 50 are transferred to header body 100. This prevents or minimizes distortion of flexible bus bar 130.

Tool interface 176 of ring body 174 permits the use of a standard square drive tool to supply torque to tighten thread on ring 168 to ring receiver 170.

The presence of vertical bus bar wall 120 and support shelf 122 forming contactor recess 112 also provide an effective spring behind flexible bus bar 130 which then resiliently forces contactors 136 securely against biplates 58. Axially force is supplied by the tightening of thread on ring 168 to ring receiver 170 thus forcing plug assembly 48 into and against header assembly 50. This provides the necessary contact force to prevent arcing.

The invention may be embodied in other specific forms without departing from the spirit of the essential attributes thereof, therefore, the illustrated embodiments should be considered in all respects as illustrative and not restrictive, reference being made to the appended claims rather than to the foregoing description to indicate the scope of the invention.

The invention claimed is:

1. An output connector for a high voltage, high current power unit, comprising:

a plug assembly including a dielectric plug body having two conductive biplates arranged generally parallel to each other along at least part of their length, each of the two conductive biplates abutting a dielectric biplate backer and the two conductive biplates separated by the dielectric biplate backer and presenting outwardly facing exposed surfaces on opposed sides of the biplate backer, a combination of the biplates and the biplate backer having a thickness;

a header assembly including a dielectric header body having a receptacle recess and presenting two substantially parallel, inwardly facing, vertical support walls on opposing sides of the receptacle recess;

a bus bar assembly including two contactors disposed in the receptacle recess, each of the two contactors being electrically and mechanically coupled to a flexible bus bar and each of the two contactors having an outwardly facing surface operably abutting the vertical support walls and the two contactors being arranged such that a space exists between the contactors, the space being sized a predetermined amount smaller than the thickness of the combination of the biplates and the biplate backer and to receive the biplate backer and biplates therein and between the contactors and the contactors to be forced outwardly against the vertical support walls; and a ring assembly operably couplable to the plug assembly and structured to force the plug assembly axially inward to the header assembly whereby the biplates and the biplate backer are forced between the contactors.

2. The output connector as claimed in claim 1, at least one of the two biplates having a straight portion and a tapered portion, the tapered portion being located at a first end of the at least one biplate that is distal from a second end of the at least one biplate to which a conductor is attachable.

3. The output connector as claimed in claim 1, wherein the dielectric plug body further comprises an inner extension portion, an outer extension portion and a centrally located disk portion between the inner extension portion and the outer extension portion.

4. The output connector as claimed in claim 3, further comprising at least one biplate ridge extending outwardly away from the outer extension portion through which one of the two biplates pass.

5. The output connector as claimed in claim 3, further comprising at least one endplate extending substantially perpendicular to the two biplates and to the biplate backer along an edge of the biplate backer.

6. The output connector as claimed in claim 1, further comprising a dust cap having a large ring having an inner diameter sized to slip fit over the dielectric header body and a small ring having an outer diameter sized to slip fit into a connector opening in a housing of the high voltage, high current power unit.

7. The output connector as claimed in claim 1, wherein the ring assembly further comprises a thread on ring couplable to the plug assembly and a ring receiver mateable to the thread on ring, the ring receiver being securable to a housing of the high voltage, high current power unit by a housing interface.

8. The output connector as claimed in claim 7, wherein the ring assembly further comprises a low friction plastic ring positioned to be compressible between the thread on ring and the ring receiver when the thread on ring and the ring receiver are mated.

9. The output connector as claimed in claim 1, wherein the flexible bus bar comprises an L-shaped structure having a first limb coupled to the contactor and second limb coupleable to terminal of the high voltage, high current power unit.

10. The output connector as claimed in claim 1, wherein the bus bar assembly further comprises a backer bar and at least one fastener, the backer bar being structured to engage the flexible bus bar to provide uniform loading of the flexible bus bar onto a terminal of the high voltage, high current power unit and the fastener being structured to couple to the terminal of the high voltage, high current power unit.

11. The output connector as claimed in claim 1, wherein the header body further presents two support shelves upon which the contactors are operably supported, the support shelves presenting a surface generally perpendicular to the vertical support walls.

12. The output connector as claimed in claim 1, wherein the header body further presents a rail centrally located therein and the plug body presents a rail receiving slot mateable with the rail.

13. The output connector as claimed in claim 2, wherein the straight portion of the two biplates and the contactors are positioned such that when the two biplates are fully inserted between the contactor, contact is made between the biplates and the contactors in the straight portion of the biplates.

14. The output connector as claimed in claim 1, wherein the ring assembly further comprises a thread on ring and the thread on ring presents a tool interface structured to receive a standard square drive tool whereby the thread on ring can be turned to tighten and loosen the thread on ring.

15. The output connector as claimed in claim 1, wherein the ring assembly further comprises a thread on ring and the thread on ring includes drain holes therein.

16. The output connector as claimed in claim 1, wherein the contactors are secured to the header body by fasteners.

* * * * *